US006450136B1

(12) United States Patent
Klomp et al.

(10) Patent No.: US 6,450,136 B1
(45) Date of Patent: Sep. 17, 2002

(54) VARIABLE COMPRESSION RATIO CONTROL SYSTEM FOR AN INTERNAL COMBUSTION ENGINE

(75) Inventors: Edward Daniel Klomp, Clinton Township; Rodney Brewer Rask, Grosse Pointe Woods, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/853,401

(22) Filed: May 14, 2001

(51) Int. Cl.[7] ..... F02B 75/04
(52) U.S. Cl. ..... 123/78 E; 123/48 B
(58) Field of Search ..... 123/78 E, 78 F, 123/48 B, 48 R, 78 R, 197.4, 197.3

(56) References Cited

U.S. PATENT DOCUMENTS 5,165,368 A 11/1992 Schechter
5,170,757 A * 12/1992 Gamache ..... 123/197.4
5,908,014 A * 6/1999 Leithinger ..... 123/78 F
5,960,750 A 10/1999 Kreuter

FOREIGN PATENT DOCUMENTS

EP 0184042 11/1985

* cited by examiner

*Primary Examiner*—Gene Mancene
*Assistant Examiner*—Hyder Ali
(74) *Attorney, Agent, or Firm*—Jeffrey A. Sedlar

(57) ABSTRACT

An internal combustion engine has a mechanism to control the compression ratio of the combustion chamber. The mechanism includes an eccentric journal bearing supporting each piston rod on the crankshaft of the engine. The journal bearing has a gear member secured thereto that meshes with an inner toothed profile of a ring gear which has an outer toothed profile that meshes with an engine-driven gear. The speed of the engine-driven gear is controllable through a differential gear mechanism to adjust the relative position of the eccentricity of the journal bearing relative to the crank throw on which it is supported. This will change the compression ratio of the combustion chamber of the engine. The mechanism, with a modification, can also be employed to control the maximum compression pressure or the maximum combustion pressure in the combustion chambers of engine.

3 Claims, 2 Drawing Sheets

VARIABLE COMPRESSION RATIO CONTROL SYSTEM FOR AN INTERNAL COMBUSTION ENGINE

TECHNICAL FIELD

This invention relates to internal combustion engines and particularly to such engines having a variable compression ratio mechanism and a control system therefor.

BACKGROUND OF THE INVENTION

The fuel economy of an internal combustion engine is related to the compression ratio of the combustion chamber. The compression ratio of the engine is the combustion chamber volume at top dead center (TDC) divided by the combustion chamber volume at bottom center (BDC). In most spark ignition engines, the compression ratio is a constant value in the range of 9.0 to 11.0. The use of a constant compression ratio is generally satisfactory; however, a variable compression ratio can improve the economy and performance by increasing the compression ratio at light loads and decreasing the compression ratio at heavy loads.

It is, therefore, advantageous to employ a variable compression ratio, and systems for providing this feature have been proposed in many publications. U.S. Pat. Nos. 5,165,368 and 5,960,750 both suggest such mechanisms and controls therefor. European Patent Application 0 184 042 also proposes a variable ratio mechanism. These systems utilize an eccentric bearing that rotatably supports the piston rod on the engine crankshaft. In the European Patent Application, the eccentric bearing is continuously rotated relative to the crankshaft and the piston rod bore in which the bearing is positioned. This relative rotation increases the friction within the engine and therefore negatively affects the fuel economy.

The variable compression ratio is also important in the success of a Homogeneous Charge Compression Ignition (HCCI) engine. These engines operate with reduced emissions at relatively high fuel economy rates. The HCCI engine needs high compression ratio to provide initial ignition of the fuel air mixture in the combustion chamber. However, the high pressure rise normally resulting from combustion must be tempered. This can be accomplished with a variable compression ratio mechanism.

SUMMARY OF THE INVENTION

It is an object of the present invention to provide an improved control mechanism for a variable compression ratio in an internal combustion engine.

In one aspect of the present invention, a variable compression ratio control maintains the eccentric crankshaft bearing stationary relative to the crankshaft when the compression ratio is constant. In another aspect of the present invention, the crankshaft bearing is rotated at a speed equal to the crankshaft speed when the compression ratio is constant. In yet another aspect of the present invention, the eccentric crankshaft bearing is rotated relative to the crankshaft during adjustment of the compression ratio.

In still another aspect of the present invention, the relative position of the eccentric crankshaft bearing is controlled by a plurality of meshing gears, one of which is secured for common rotation with the crankshaft bearing. In yet still another aspect of the present invention, a second of the plurality of meshing gears has both internal and external teeth formed thereon. In a further aspect of the present invention, the inner teeth of the second gear mesh with the gear on the crankshaft bearing and the outer teeth mesh with an engine-driven gear. In a yet further aspect of the present invention, the engine-driven gear is drivingly connected with the engine crankshaft through a differential gear mechanism that is controllable to vary the speed of the engine-driven gear during a change of the compression ratio. In a still further aspect of the present invention, the engine-driven gear is equipped with a lost motion mechanism, in the form of a spring, which permits a temporary change in the compression ratio during either the compression stroke or the power stroke.

DESCRIPTION OF AN EXEMPLARY EMBODIMENT

Figure 1:
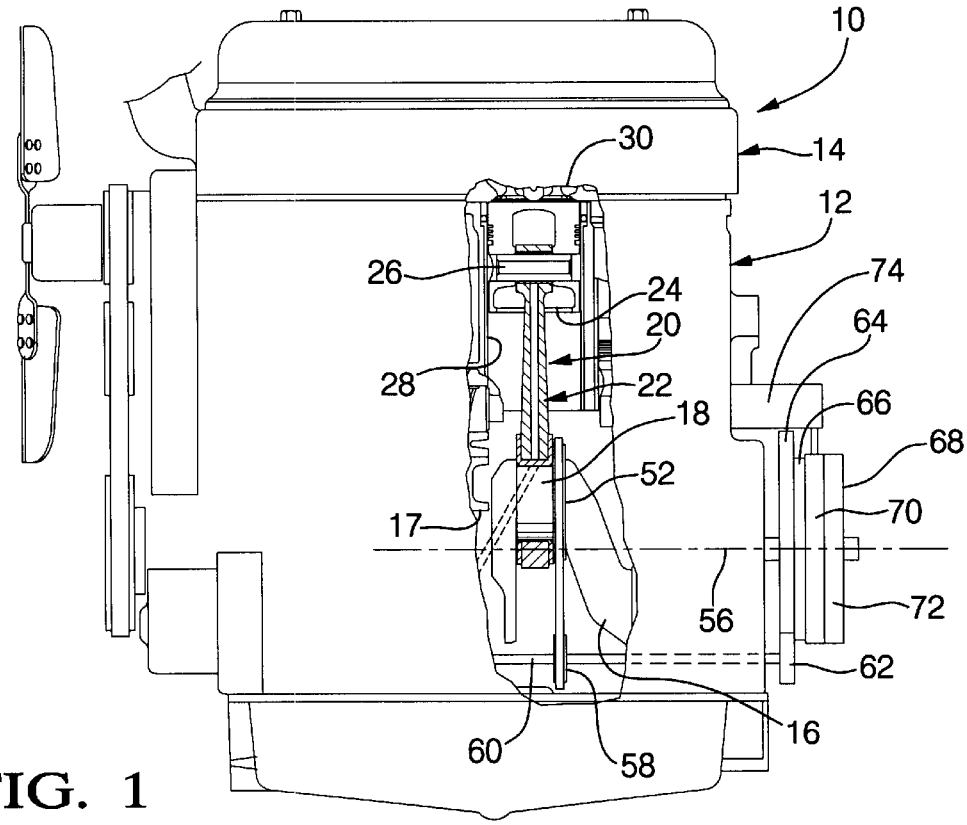
FIG. 1 is an elevational view, partially in section, of an engine incorporating the present invention.

Referring to the drawings, wherein like characters represent the same or corresponding parts throughout the several views, there is seen an engine 10 that includes a cylinder block 12 and a cylinder head 14. A crankshaft 16 is rotatably supported in the cylinder block 12 on bearings 17. The crankshaft 16 has a plurality of throws 18. A piston assembly 20 is supported on each throw 18 and is thereby drivingly connected with the crankshaft 16. Each piston assembly 16 is comprised of a piston rod 22 and a piston 24 which is connected with the piston rod 22 by a wrist pin 26. The piston 24 is slidably disposed in a cylinder 28, formed in the cylinder block 12, and is reciprocally driven therein through the action of the crankshaft 16 and the piston rod 22. This is a well-known action of an internal combustion engine.

The piston 24, cylinder 28, and cylinder head 14 cooperate to form a combustion chamber 30 which has a minimum volume when the piston 24 is at the top dead center (TDC) position shown and a maximum volume when the piston is at a bottom dead center (BDC) position. The BDC position occurs when the crankshaft 16 is been rotated 180 degrees from the position shown. The ratio of the volume at BDC to the volume at TDC is the compression ratio (CR) of the engine 10. The combustion chamber 30 changes in volume as the piston is moved from the BDC position to the TDC position. This occurs twice during the operating cycle—once during the compression stroke and once during the exhaust stroke. During the exhaust stroke, the exhaust valves, not shown, are open to discharge the products of combustion. The combustion chamber 30 increases in volume twice during the operating cycle—once during the intake stroke and once during the expansion or power stroke. The intake valves, not shown, are opened during the intake stroke to ingest an air mass. The valves are closed during the compression stroke and the power stroke. This is a well-known operating cycle.

The air mass in the combustion chamber is compressed during the compression stroke and the temperature thereof rises as the volume is decreased. The amount of temperature rise is, in part, dependant upon the CR of the engine. A fuel charge is injected by a conventional fuel injector, not shown, into the heated air mass at or slightly before TDC. The temperature of the air mass is generally sufficient, in compression ignition (CI) engines such as Homogeneous Charge Compression Ignition (HCCI) engines, to cause the fuel air mixture to ignite and rapidly expand, thereby forcing the piston toward BDC to complete the power stroke. In many compression ignition engines, a glow plug or coil is employed to initiate combustion when the engine is cold started. In a spark ignition (SI) engine, an ignition source such as a spark plug is incorporated and energized to initiate combustion.

As is well known, it is desirable to increase the CR of a CI engine during the starting procedure, even when a glow plug is in use, to increase the temperature of the air mass. It is also well known that the economy and performance of a SI engine can be improved at light load operation by increasing the CR of the engine.

Figure 3:
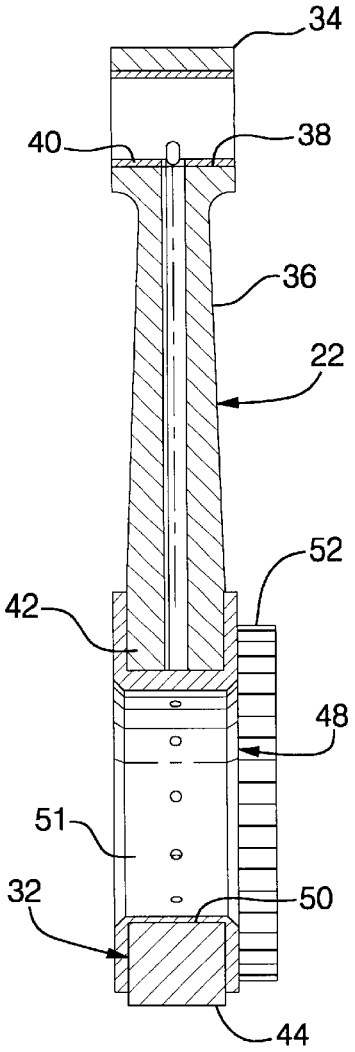
FIG. 3 is an elevational sectional view of a piston rod and crankshaft bearing assembly employed in the engine shown in FIGS. 1 and 2.
Figure 4:
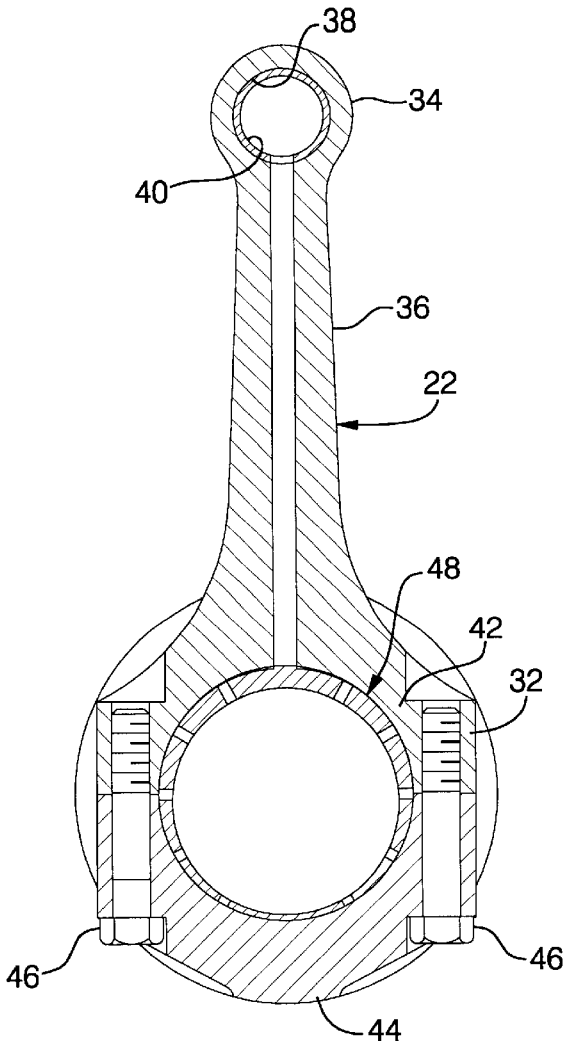
FIG. 4 is a side sectional view of the piston rod shown in FIG. 3.

FIGS. 3 and 4 depict the piston rod 22. The piston rod 22 includes a big end 32, a small end 34, and a connecting portion 36. The small end 34 has a bore 38 in which a wrist pin bearing 40 is installed. The big end 32 has a top half 42, formed integrally with the connecting portion 36, and a cap 44 that is secured to the top half by fasteners 46. A journal bearing assembly 48 is secured in a bore 50 formed by the top half 42 and the cap 44. The journal bearing assembly 48 includes a bearing portion 51 and a gear member 52. The bearing portion 51 supports the piston rod 22 on the throw 18 while permitting relative rotation therebetween. The gear member 52 is secured to the bearing portion 50 and is disposed adjacent the big end 32. The gear member 52 controls the position of the eccentricity of the bearing portion 51 within the bore 50. The position of the eccentricity of the bearing portion 51 establishes the volume of the combustion chamber 30 and therefore the CR of the engine 10.

Figure 2:
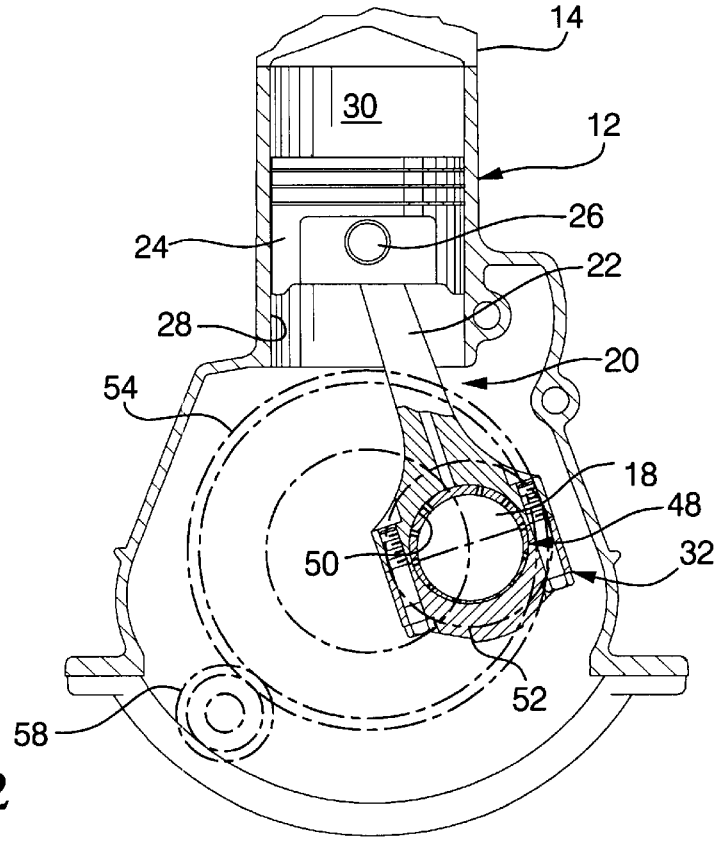
FIG. 2 is a sectional end view of an engine incorporating the present invention.

As best seen in FIG. 2, the gear member 52 meshes with a ring gear member 54 that is rotatably supported on the centerline 56 of the crankshaft 16. The ring gear member 54 has teeth formed on both the inner periphery and the outer periphery thereof. The gear member 52 meshes with the inner teeth and second gear member 58 meshes with the outer teeth. The second gear member 58 is drivingly connected with a shaft 60 that extends the length of the engine 12. Each piston assembly 20 of the engine 10 has associated therewith a gear train, the same as that described above. The shaft 60 drives a gear member for each of these gear trains.

The shaft 60 is also drivingly connected with a gear 62 that meshes continuously with an output gear 64. The gear 64 is connected for co-rotation with a side gear 66 of a differential gear assembly 68 that also includes a differential carrier 70, a side gear 72, and a pair of planet gear members, not shown, that each continually mesh with the side gears 66 and 72. The side gear 72 is drivingly connected with the crankshaft 16. The differential gear assembly 68 operates as a conventional mechanism. That is, if the differential carrier is held stationary, the side gears 66 and 72 will rotate at the same speed, i.e., crankshaft speed, but in opposite directions. The output gear 64 rotates with the side gear 66, and the gear 62 is driven in a direction opposite the gear 62 and therefore rotates in the same direction as the crankshaft 16 at a speed proportional thereto. If the differential carrier 70 is rotated, the side gear 66 will rotate either faster or slower than the side gear 72, depending on the rotational direction of the differential carrier 70. This differential action is well known to those skilled in the art.

A conventional control mechanism 74 is provided to control the direction and speed of the differential carrier. The control mechanism 74 is preferably controlled by an electronic control module (ECM) that also controls some of the engine functions, such as fuel feed, and some power transmission function. The control mechanism 74 will hold the differential carrier 70 stationary when the CR of the engine 10 is unchanging. When a change in the CR of the engine 10 is desired, the control mechanism 74 will rotate the differential carrier the appropriate amount and direction. When the differential carrier 70 is rotated, the speed of the gears 62 and 58 will change relative to the speed of the crankshaft 16. This causes the gear 54 to change speed, which results in the gear 52 rotating the bearing assembly 48 relative to the piston rod 22 and thereby changing the position of the eccentricity of the bearing portion 51.

To adjust the CR of the engine 10, the differential carrier 70 is rotated by the control 74. If the differential carrier 70 is rotated in the same direction as the crankshaft 16, the side gear 66 will rotate slower as will the gear members 74, 62, 58, and 54. This will result in the gear 52 and bearing portion 51 rotating relative to the bore 50 in a counterclockwise direction to cause the CR of the engine to be adjusted. If the differential carrier 70 is rotated opposite the crankshaft direction, the opposite effect will occur. Thus, to adjust the CR of the engine 10, the differential carrier 70 is rotated in one direction, and to return the CR to the previous value, the differential carrier 70 is rotated in the opposite direction. Of course, the differential carrier 70 can be rotated in one direction to change the CR of the engine 10, and continued rotation in that one direction will return the CR to the initial setting also.

The position of the eccentricity of the bearing portion 51 is positionable to change the CR of the engine 10 between a maximum value and a minimum value. When the ECM determines that the engine is to operate at light loads, the bearing assembly is positioned, as shown, to provide the maximum CR for the engine 10. As the load increases, the ECM will command the control mechanism 74 to operate to reduce the CR of the engine 10 accordingly. When the appropriate CR of the engine 10 is achieved, the control mechanism 74 will hold the differential carrier 70 stationary until another change of CR is required.

Figure 5:
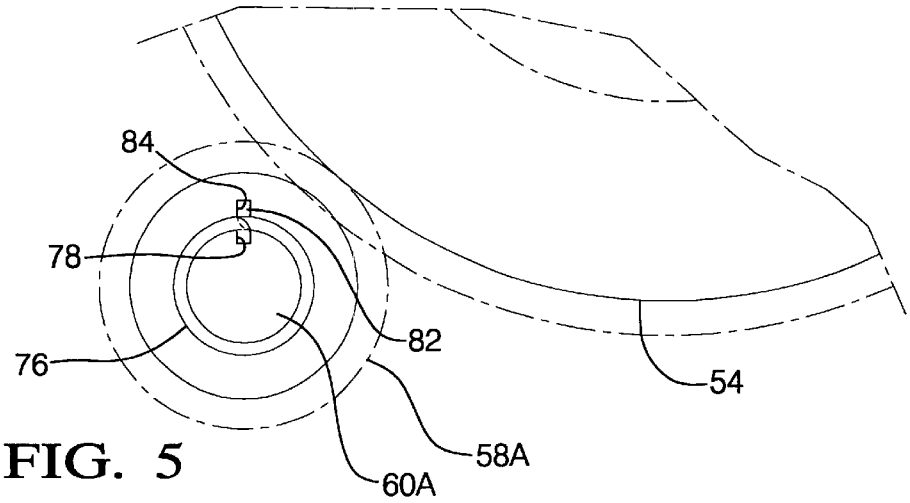
FIG. 5 is an alternative construction of an engine-driven gear utilized in the engine shown in FIG. 2.

In some engines it may be desirable to limit the maximum pressure in the combustion chamber after ignition occurs. This can be accomplished with the present invention by employing the modification shown in FIG. 5. The gear 58A corresponds to the gear 58. The gear 58A is rotatably supported on the shaft 60A and drivingly connected thereto by a torsion spring 76. The torsion spring 76 has a first tab end 78 disposed in a bore 80 formed in the shaft 60A and a second tab end 82 disposed in a bore 84 formed in the gear 58A. The spring 76 is preloaded to mesh with the gear 54 in the direction opposite engine rotation when the maximum desired pressure is to be limited. If the maximum desired pressure is exceeded, the forces on the gear 54 will cause the gear 58A to rotate slightly in the direction of crankshaft rotation which in turn will rotate the gear 52, thereby increasing the volume of the combustion chamber temporarily. The gears 58A and 52 will return to the preset position during the power stroke when the force on the piston 24 is sufficiently reduced. This can be particularly useful in HCCI engines. The bearing assembly 48 will return to the position established by the preload position of the gears. Thus, the spring 76 effectively places a lost motion mechanism between the shaft 60A and the gear 58A. In the alternative, the lost motion mechanism can also be utilized to limit the CR of the engine if desired.

What is claimed is:

1. A mechanism for controlling the compression ratio of an internal combustion engine having a piston and piston rod drivingly connected with a crankshaft and reciprocally mounted in a cylinder to form an expansible and contractible combustion chamber, said mechanism comprising:

an eccentric bearing disposed between the piston rod and the crankshaft;

a first gear member connected with said eccentric bearing for common rotation therewith;

a second gear member having both an internal toothed portion and an external toothed portion, said second gear member being rotatably mounted on a centerline of the crankshaft, said internal toothed portion meshing with said first gear member;

a third gear member meshing with said external toothed portion and being drivingly connected with a shaft extending parallel to said centerline of the crankshaft;

a position control mechanism comprising a differential gear set having a differential carrier, first and second side gears rotatably mounted on said differential carrier, and an output gear, said first side gear being continuously drivingly connected with the crankshaft, said second side gear being drivingly connected with said output gear and rotating at the same speed but in the opposite direction as said first side gear when said differential carrier is held stationary;

a fourth gear member drivingly connected with said shaft and meshing with said output gear to thereby rotate said shaft and said third gear member at a speed proportional to the speed of said second side gear in the same direction as said crankshaft; and a differential control mechanism for controlling the speed and direction of said differential carrier.

2. The mechanism defined in claim 1 further comprising:

the engine having a compression ratio effected by said piston and combustion chamber, the combustion chamber being subjected to a compression pressure;

said fourth gear member being connected with said shaft through a lost motion mechanism including a spring to permit said third gear and said second gear to rotate relative to said shaft to effect a change in the compression ratio of the combustion chamber of the engine when the pressure therein exceeds a predetermined value.

3. The mechanism defined in claim 1 further comprising:

the engine having a compression ratio effected by said piston and combustion chamber, the combustion chamber being subjected to a combustion pressure;

said fourth gear member being connected with said shaft through a lost motion mechanism including a spring to permit said third gear and said second gear to rotate relative to said shaft to effect a change in the compression ratio of the combustion chamber of the engine when the combustion pressure therein exceeds a predetermined value.

* * * * *